US005319420A

United States Patent [19]

Fox et al.

[11] Patent Number: 5,319,420

[45] Date of Patent: Jun. 7, 1994

[54] APPARATUS FOR CONTROLLING THE FLOW OF DEVELOPER MATERIAL IN A DEVELOPMENT STATION

[75] Inventors: Richard S. Fox, Rochester; Frederick J. Case, Hamlin, both of N.Y.

[73] Assignee: Eastman Kodak Company, Rochester, N.Y.

[21] Appl. No.: 791,703

[22] Filed: Nov. 14, 1991

[51] Int. Cl.[5] ..... G03G 15/09

[52] U.S. Cl. ..... 355/253; 118/656; 118/661

[58] Field of Search ..... 355/245, 246, 253, 251, 355/260; 222/DIG. 1; 118/653, 656-657, 661

[56] References Cited

U.S. PATENT DOCUMENTS

| | | | |
|---|---|---|---|
| 4,746,952 | 5/1988 | Kusuda et al. | 355/253 |
| 4,748,471 | 5/1988 | Adkins | 355/253 |
| 4,955,316 | 9/1990 | Asanuma et al. | 118/657 |
| 4,956,674 | 9/1990 | Kalyandurg | 355/251 |
| 4,982,690 | 1/1991 | Funayama | 118/657 |
| 5,023,670 | 6/1991 | Kita et al. | 355/326 |
| 5,028,961 | 7/1991 | DeCecca | 355/260 |

*Primary Examiner*—A. T. Grimley
*Assistant Examiner*—Shuk Y. Lee
*Attorney, Agent, or Firm*—David A. Howley

[57] ABSTRACT

An apparatus for controlling a flow of developer material in a development station. Gating means for regulating the flow of developer material in a development station are mounted for movement between an open position, allowing a flow of developer material and a closed position inhibiting the flow. An abutment, movable with the gating means, has a pair of opposed surfaces and contacts a limiting surface when the gating means is in the open position. A crank is drivingly connected to a drive means. The crank has a portion which engages one of the opposed surfaces when the drive mechanism moves the crank in one direction. This causes the gating means to move toward the open position. The crank engages the other opposed surface when the drive means moves the crank in an opposite direction. This causes the gating device to move to the closed position.

10 Claims, 2 Drawing Sheets

APPARATUS FOR CONTROLLING THE FLOW OF DEVELOPER MATERIAL IN A DEVELOPMENT STATION

TECHNICAL FIELD

This invention relates generally to development stations for applying marking particles to a surface and, more particularly, to an apparatus for controlling the flow of developer material within such a development station.

BACKGROUND OF THE INVENTION

It is well known in the electrographic art to use magnetic brush development apparatus for applying marking particles to latent images on a photoconductor or other image member that is advanced past the magnetic brush. Developer material, comprised of magnetic carrier particles and marking particles, may initially be mixed in a sump to triboelectrically charge the material prior to delivering it to a developer roller of the magnetic brush apparatus. It is also known to meter the flow of developer material to the magnetic brush and to gate, or shut off, the flow of material to the brush under certain circumstances. Metering of the developer material can be accomplished by a skive or by feeding the material through a slot leading to the magnetic brush. Gating of the developer material may be achieved by isolating the slot from the magnetic brush.

Such a slot-feeding apparatus is disclosed in commonly assigned U.S. Pat. No. 4,956,674, issued on Sep. 11, 1990 in the name of Kalyandurg. This apparatus has a rotary feed mechanism which delivers developer material from a sump to a magnetic brush. A gating device between the sump and the magnetic brush rotates about an axis substantially coaxial with the rotary feed mechanism between (1) an open position communicating the magnetic brush and the sump and (2) a closed position substantially isolating the magnetic brush from the sump. The gating device is drivingly connected to a solenoid by a linking mechanism. While such a method of connecting the solenoid to the gating device operates well for its intended purpose, it does involve a number of moving parts. Over time, these part will wear, making it more difficult to accurately position the gating device. A mechanism is desired which will accurately position the gating device over an extended period of time.

In the Kalyandurg apparatus, the rotation of the gating device from the closed to the open position is opposed to the flow of developer material within the gating device. When the solenoid is energized to rotate the gating device to its open position, the solenoid will have to overcome the resistance caused by the flow of developer material within the gating device. An apparatus wherein rotation of the gating device from a closed to an open position is in the direction of developer material flow would decrease the time and energy it takes to rotate the metering device from the closed position to the open position.

A lower slot in the Kalyandurg gating device occupies only about 25° of the circumference of the gating device. When the gating device is in the closed position, a certain amount of developer material will be trapped in the gating device. An arrangement allowing most of the developer material to flow back into the sump for continuous mixing would be more desirable.

SUMMARY OF THE INVENTION

In consideration of the above discussion, it is an object of the present invention to provide an apparatus which can accurately position a gating device.

A further object of the invention is to provide an apparatus in which the rotation of the gating device from a closed to an open position is in the same direction as the flow of developer material within the gating device.

Another object of this invention is to provide an apparatus in which most of the developer material may escape the gating device when the gating device is in a closed position.

This invention is directed to an apparatus for controlling a flow of developer material in a development station. Gating means for regulating the flow of developer material in a development station are mounted for movement between an open position, allowing a flow of developer material and a closed position inhibiting the flow. An abutment, movable with the gating means, has a pair of opposed surfaces and contacts a limiting surface when the gating means is in the open position. A crank is drivingly connected to a drive means. The crank has a portion which engages one of the opposed surfaces when the drive mechanism moves the crank in one direction. This causes the gating means to move toward the open position. The crank engages the other opposed surface when the drive means moves the crank in an opposite direction. This causes the gating device to move to the closed position.

This invention allows the gating means to be accurately positioned when in the open position. This is accomplished by the use of a limiting member to halt the rotation of the gating means when it is in the correct location. The gating means is not rigidly connected to the drive mechanism, and thus the gating means is not dependent on the drive mechanism to accurately place it in the proper open position. The drive mechanism only begins the rotation of the gating means to the open position. Rotation of the gating means to the open position is completed by inertia and the frictional force of developer material engaging the gating means. In the prior art, the gating means is rigidly linked to a solenoid by a number of moving parts. Over time, as the parts wear and the solenoid ages, the accuracy with which the gating means can be placed in the open position will decrease.

Another advantage of the present invention is that the gating means, when rotating from a closed to an open position, rotates in the same direction as the flow of developer material within the gating means. This will increase the speed with which the gating means can reach its open position because it will be assisted, not hindered, by the flow of developer material.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

BEST MODE FOR CARRYING OUT THE INVENTION

Figure 2:
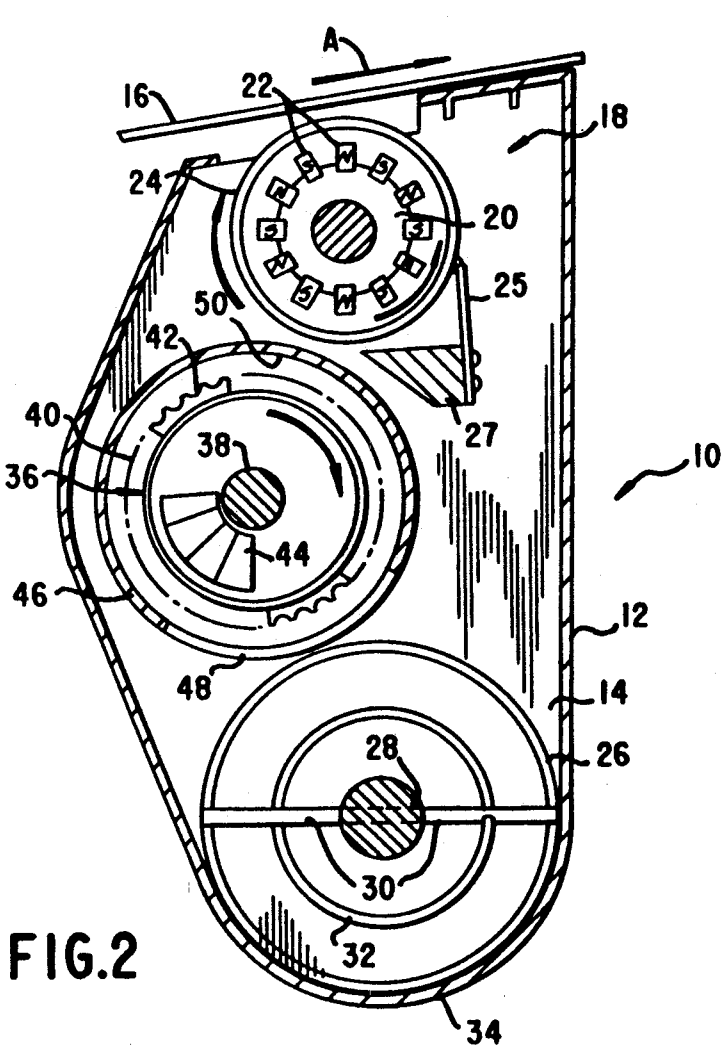
FIG. 2 is a view similar to FIG. 1 showing parts in a different orientation.

In the following description, direction terms such as up, down, left, right, clockwise, counter-clockwise, over, under, etc., are intended to convey a sense of direction relative to positions and orientations depicted in the drawings. These terms are not meant to infer direction and orientations of use and/or operation unless otherwise stated.

Referring now to the drawings, a development station of an electrostatographic printer/copier is generally designated 10 and comprises a housing 12 that defines a sump 14 for receiving developer material. The developer material consists of marking particles and, possibly, magnetic carrier particles. An image member 16, such as a photoconductor, travels across the upper portion of the housing in the direction shown by an arrow A and contains on its lower surface one or more latent electrostatic images that are developed by developer material from sump 14. The developed images can be transferred to a copy sheet and fused thereto in a known manner or fused onto the image member itself.

The development apparatus 10 includes a magnetic brush 18 for applying marking particles to the images on image member 16. The brush illustrated comprises a core 20 having a plurality of magnets 22 spaced around the core and a cylindrical, nonmagnetic shell 24 that surrounds the core 20. The core and/or shell can be fixed or rotating, as is known in the art. As illustrated in the drawings, core 20 rotates in a counter-clockwise direction, and the shell rotates in a clockwise direction, to thereby feed developer material to the image member. A blade 25 supported from a bar 27 has a free end that engages the shell 24 downstream of a development zone between the shell and image member to remove unused developer material from the shell and return it to the sump.

Developer material in sump 14 can be mixed, agitated and triboelectrically charged by means of a ribbon blender, generally designated 26. Blender 26 comprises a shaft 28 that is rotatable about its axis and has a plurality of rods 30 projecting therefrom. The rods carry inner and outer helical ribbons 32 and 34. The pitch of the ribbon 32 is opposite from ribbon 34 so that when the shaft 28 is driven in a counter-clockwise direction, as ilustrated, ribbon 32 tends to drive developer material in one direction through the sump 14 while ribbon 34 tends to drive the material in the opposite direction. A ribbon blender is especially useful for mixing developer material having permanent magnetic carrier particles, such as disclosed in U.S. Pat. No. 4,546,060.

Material from sump 14 is moved by the ribbon blender, not only axially in the sump but also radially outwardly, so that some of the material is provided to a feeding mechanism generally designated 36. The feeding mechanism is located between the top of the ribbon blender and the bottom of the magnetic brush. The feeding mechanism includes a shaft 38 that can be driven in a clockwise direction. A generally cylindrical transport roller 40 surrounds shaft 38 and is connected to it so that the roller is driven when the shaft is rotated. The outer surface of roller 40 is deeply fluted, as shown at 42, to form a plurality of recesses and ridges that extend axially along the roller. The surface could also be grooved, or otherwise roughened or textured. The roller can be made from any suitable material, such as extruded aluminum, plastic, etc.

Between the roller 40 and shaft 38, there is a stationary permanent magnet 44. The magnet is located beneath the shaft 38 and to the left thereof, and generally above and to the left of the ribbon blender 26. The magnet illustrated in the drawings extends through an arc of about 80°. It is located so that the developer material mixed by the ribbon blender is attracted to the outer surface of roller 40 by magnet 44 and held on the roller by the magnet as it is transported in a clockwise direction by the roller toward the magnetic brush. The position of the magnet, together with its accurate dimension, assures that the developer material will be held onto the roller until it reaches a point where the material can be held onto the roller by the flutes 42 and gravity alone. The developer material is then carried by the fluted surface to a location proximate the magnetic brush where it can be attracted to the magnetic brush by magnets 22 in the brush.

A shell 46 is positioned about roller 40 and is spaced therefrom in order to provide an annular space for the flow of developer material between the roller and shell 46. Shell 46 is a cylindrical member and can be made from plastic or other suitable materials. The shell 46 is concentric with roller 40 and extends along the development apparatus substantially the same distance as magnetic brush 18. Shell 46 has a relatively wide first slot 48 and a much narrower second slot 50. Both slots are generally rectangular in shape, and extend substantially the full length of shell 46. The width of each slot extends circumferentially along shell 46 so that each slot has two opposed longitudinally extending side edges. In the embodiment illustrated in the drawings, the midpoints of slots 48 and 50 are approximately 170° apart. The spacing of the slots depends, in part, on the location of the feeding mechanism and the shell relative to the ribbon blender and magnetic brush. The slots are spaced so that when shell 46 is in a position illustrated in FIG. 2, slot 48 is substantially aligned with the bottom of roller 40 and between magnet 44 and the ribbon blender. Slot 50 extends along the portion of shell 46 that is nearest to shell 24 of magnetic brush 18.

Figure 1:
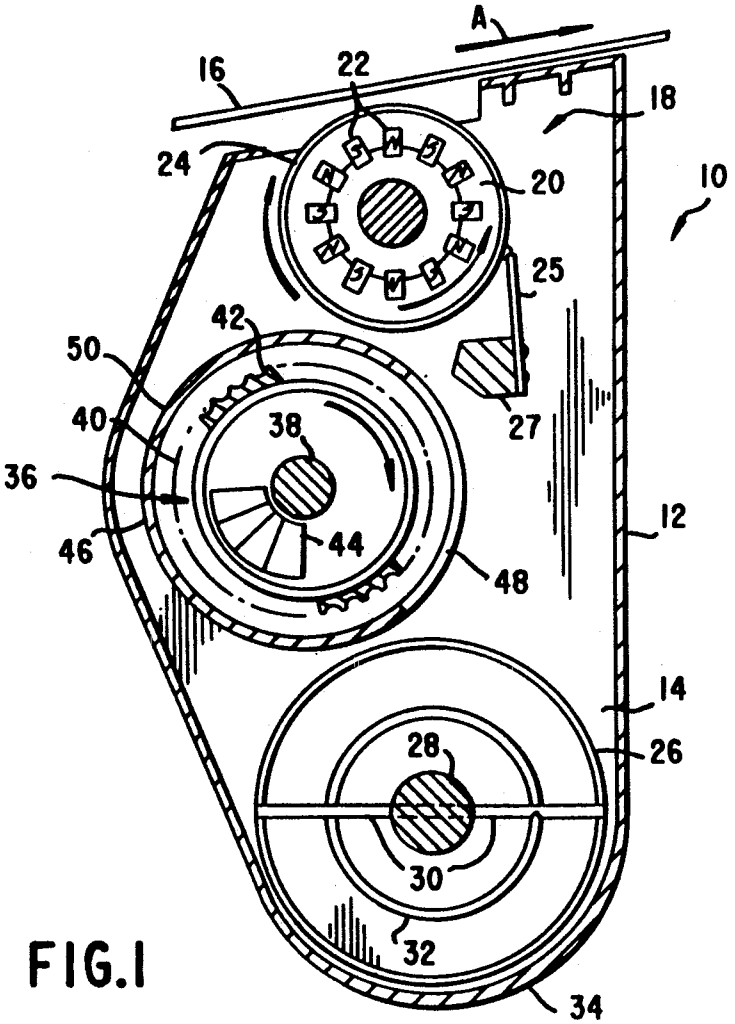
FIG. 1 is an end elevational view, partly in cross-section, of a magnetic brush development apparatus.

Slot 48 is relatively wide so that a substantial amount of developer material from sump 14 can pass through slot 48 and enter the space between shell 46 and roller 40 to be transported by roller 40 to slot 50. Slot 50, on the other hand, is much narrower and meters the desired amount of developer material to the magnetic brush. The slots may have various dimensions depending upon a number of factors. By way of example, slot 50 can be approximately 0.05 inch wide. In a preferred embodiment, slot 48 covers at least 40°, ideally about 100°, of the circumference of shell 46. Shell 46 is rotated between the positions shown in FIG. 1 and FIG. 2 to gate the flow of developer material to the magnetic brush.

Figure 3:
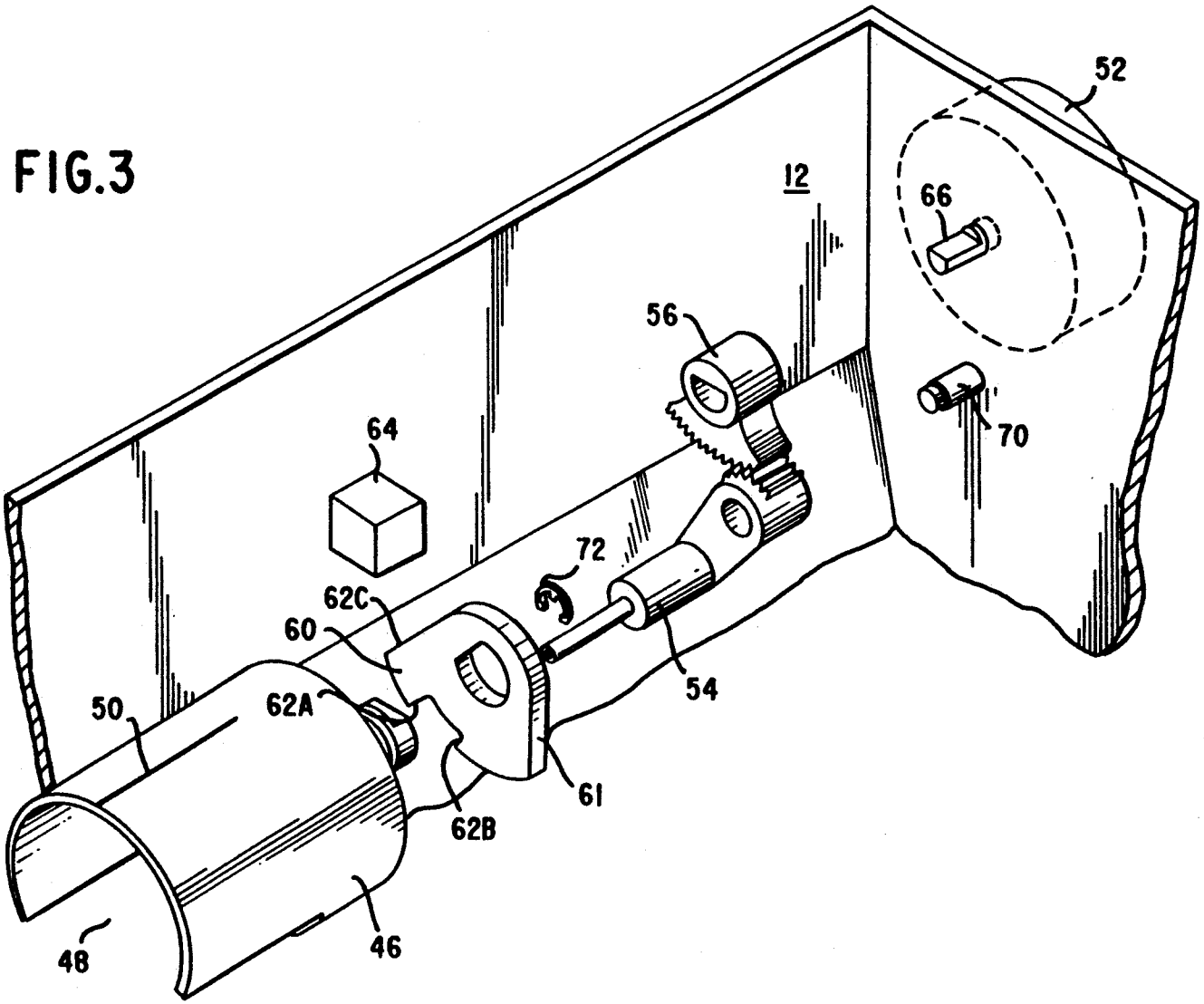
FIG. 3 is a perspective view of a portion of the apparatus embodying the invention, not shown in FIGS. 1 and 2, showing parts in exploded form.

FIG. 3 presents an exploded view of shell 46 and a mechanism used to rotate shell 46 between an open position and a closed position. A solenoid 52 is connected to a suitable power supply (not shown). The solenoid can be controlled from a logic and control unit of the associated electrostatographic printer/copier so that it is actuated at precisely the correct time relative to the movement of images on the image member past the development apparatus. A gear 56 engages and is rotatably driven by a solenoid shaft 66. A crank 54 is rotatably held on a post 70 by an E-ring 72. Teeth on gear 56 engage teeth on crank 54 such that gear 56 can rotate crank 54 about post 70. Shell 46 has an abutment 60 attached to the shell at one end. A perimeter surface 61 of abutment 60 defines a notch 62. Crank 54 extends into notch 62.

When it is desired to rotate shell 46 from a closed position (see FIG. 1) to an open position (see FIG. 2), solenoid 52 is actuated. Solenoid 52 causes shaft 66 and gear 56 to rotate in a counter-clockwise direction. Rotation of gear 56 causes crank 54 to rotate in a clockwise direction about post 70. The clockwise motion of crank 54 causes the crank to strike surface 62*a* of abutment 60, causing the abutment and thus shell 46 to also rotate in a clockwise direction.

In an alternative embodiment, gear 54 and post 70 are not utilized. Solenoid 52 is moved to a position such that solenoid shaft 66 is in the same position where post 70 used to be. Crank 54 is attached directly to solenoid shaft 66. In this embodiment, a solenoid would have to be used which would cause solenoid shaft 66 to rotate in a clockwise direction when the solenoid is actuated.

As shell 46 rotates clockwise, slot 48 is rotated toward blender 26. Developer material provided by blender 26 may now enter shell 46 through slot 48. The developer material is attracted to those areas of roller 40 adjacent magnets 44. The roller 40 transports the developer material in a clockwise direction. The developer material fills the space between roller 40 and shell 46.

At a point prior to shell 46 reaching its open position, solenoid shaft 66 reaches its limit of rotation. Crank 54 stops rotating clockwise and, therefore, no longer rotates shell 46 in a clockwise direction. From this point on, the only forces causing shell 46 to rotate in a clockwise direction are ineretia and the frictional force caused by the developer material engaging the inside of the shell. The distance between surface 62*a* and a surface 62*b* of plate 60 is such that shell 46 can continue to rotate in a clockwise direction to its open position without interference from crank 54.

The rotation of shell 46 in a clockwise direction is stopped when surface 62*c* of abutment 60 contacts a limiting member 64. The limiting member 64 is secured to a side of housing 12. Shell 46 is now in the position displayed in FIG. 2. In this position, developer material may pass through slot 50 under the influence of its magnetic attraction to magnetic brush 18. Shell 46 is held in the open position by the continuous collision of developer material against the inside surface of shell 46. Solenoid 52 remains energized, and the only torque force that the solenoid must overcome is the torque force of a solenoid return spring (not shown). The use of the limiting member to position the shell guarantees that the shell will always be located properly when in the open position.

When it is desired to discontinue the supply of developer material to the magnetic brush, the solenoid is de-energized. The solenoid return spring, not shown, causes shaft 66 and gear 56 to rotate in a clockwise direction. Gear 56 causes crank 54 to rotate counter-clockwise about post 70. Crank 54 strikes surface 62*b* of abutment 60, causing the abutment, and thus shell 46, to rotate counter-clockwise. Shell 46 is rotated counter-clockwise until it reaches the position displayed in FIG. 1. At this point, slot 48 is not adjacent to blender 26, inhibiting the flow of developer material to the feeding mechanism. Slot 50 is not adjacent to the magnetic brush, and thus no developer material will be attracted to the magnetic brush. Due to the large width of slot 48, developer material can leave shell 46 to be remixed in sump 14 by blender 26.

The invention has been described in detail with particular reference to a preferred embodiment thereof, but it will be understood that variations and modifications can be effected within the spirit and scope of the invention as described hereinbefore and as defined in the appended claims. The invention is useful in any apparatus in which marking particles must be applied to a surface, not just electrophotographic apparatus.

It is claimed:

1. Apparatus for controlling a flow of developer material in a development station, said apparatus comprising:

drive means;

gating means for regulating a flow of developer material in a direction within a development station, said gating means being mounted for movement between an open position, allowing said flow of developer material and a closed position inhibiting such flow;

a limiting member;

an abutment movable with said gating means, said abutment (1) having a pair of opposed surfaces and (2) being limited in movement by contact with said limiting member when said gating means is in said open position;

a crank drivingly connected to said drive means for movement thereby, said crank having a portion which engages one of said opposed surfaces when said drive means moves said crank in one direction to cause said gating means to move toward said open position; and which engages the other of said opposed surfaces when said drive means moves said crank in an opposite direction to cause said gating means to move to said closed position.

2. An apparatus as defined in claim 1 wherein the developer material flows within the gating means and wherein said gating means moves in the same direction as the flow of developer material within said gating means when said gating means moves from said closed to said open position.

3. An apparatus as defined in claim 1 wherein said gating means comprises a shell (1) having a circumference and mounted for rotation about an axis, and (2) having a first slot occupying at least 40° of the circumference of said shell, and a second slot, said slots being essentially parallel to the axis of rotation of said shell.

4. An apparatus as defined in claim 3 wherein the developer material flows within the shell and wherein said shell rotates in the same direction as the flow of developer material within said shell when said shell rotates from said closed to said open position.

5. An apparatus as defined in claim 3 wherein said first slot occupies about 100° of the circumference of said shell.

6. Apparatus for controlling a flow of developer material in a development station, said apparatus comprising:

gating means movable between an open position and a closed position for regulating a flow of developer material within a development apparatus, said developer material flowing within and engaging said gating means; and drive means for moving said gating means from said open position to said closed position and for moving said gating means from said closed position toward said open position, said drive means causing said gating means to move only to a point partway from said closed position to said open position, movement of said gating means from said point to said open position being caused by inertia and frictional force caused by developer material engaging the gating means.

7. An apparatus as claimed in claim 6 wherein said drive means comprises a solenoid.

8. An apparatus as defined in claim 7 wherein said drive means further comprises a crank and a gear interposed between and connected to said solenoid and said crank such that said gear is rotatable by said solenoid and said crank is rotatable by said gear.

9. Apparatus according to claim 6 further including a stationary limiting member for engaging and limiting movement of the gating means in its open position with the gating means held in its open position against the limiting member by the flow of developer and not by the drive means.

10. Apparatus according to claim 9 wherein the gating means includes a shell having an inside and entrance and exit openings for developer movable around the inside of the shell, positions of the openings being movable by rotation of the shell to move the gating means between its open and closed positions.

* * * * *